US007764255B2

(12) United States Patent
Yen et al.

(10) Patent No.: US 7,764,255 B2
(45) Date of Patent: Jul. 27, 2010

(54) LIQUID CRYSTAL ON SILICON (LCOS) DISPLAY DRIVING SYSTEM AND THE METHOD THEREOF

(75) Inventors: Cheng-Chi Yen, Hsinhua (TW); Hon-Yuan Leo, Hsinhua (TW); Yung-Yuan Ho, Hsinhua (TW); Yen-Chen Chen, Hsinhua (TW)

(73) Assignee: Himax Technologies Limited (TW)

( * ) Notice: Subject to any disclaimer, the term of this patent is extended or adjusted under 35 U.S.C. 154(b) by 998 days.

(21) Appl. No.: 11/052,914

(22) Filed: Feb. 9, 2005

(65) Prior Publication Data

US 2006/0176256 A1 Aug. 10, 2006

(51) Int. Cl.
*G09G 3/36* (2006.01)

(52) U.S. Cl. ..... 345/88; 348/800

(58) Field of Classification Search ..... 345/88, 345/90, 98, 100, 204; 348/800
See application file for complete search history.

(56) References Cited

U.S. PATENT DOCUMENTS

| | | | | |
|---|---|---|---|---|
| 6,097,632 | A | 8/2000 | Roohparvar | |
| 2006/0082603 | A1 * | 4/2006 | Shimada | 345/690 |
| 2006/0132405 | A1 * | 6/2006 | Bai et al. | 345/88 |

* cited by examiner

*Primary Examiner*—Amare Mengistu
*Assistant Examiner*—Vinh T Lam

(57) ABSTRACT

The present invention relates to a LCOS display driving system. The driving sequential control block generates a control code representing a loading sequence of the R, G, and B data for pixels in one of scan lines. The multiplexer multiplexes the R, G, and B data from latches according the control code. The shared level shifter shifts the level of the R, G, and B data from the multiplexer. The digital analog converts converting the R, G, and B data to a corresponding analog R, G, and B data voltage. The shared unity-gain buffer stores the analog R, G, and B data voltage from the shared digital analog converter. The demultiplexer demultiplexes the analog R, G, and B data voltage according the control code.

22 Claims, 14 Drawing Sheets

500

100

200

710A 710B

| | | | | | |
|---|---|---|---|---|---|
| Control code 4 | EVEN BRG | ODD GRB | EVEN BRG | ODD GRB | 710 |
| Control code 5 | EVEN GRB | ODD BRG | EVEN GRB | ODD BRG | 720 |
| Control code 0 | EVEN RGB | ODD BGR | EVEN RGB | ODD BGR | 730 |
| Control code 1 | EVEN BGR | ODD RGB | EVEN BGR | ODD RGB | 740 |
| Control code 2 | EVEN RBG | ODD GBR | EVEN RBG | ODD GBR | 750 |
| Control code 3 | EVEN GBR | ODD RBG | EVEN GBR | ODD RBG | 760 |

700B

Fig. 7B

710A

710B

| | | | | | |
|---|---|---|---|---|---|
| Control code 2 | EVEN RBG | ODD GBR | EVEN RBG | ODD GBR | 710 |
| Control code 3 | EVEN GBR | ODD RBG | EVEN GBR | ODD RBG | 720 |
| Control code 4 | EVEN BRG | ODD GRB | EVEN BRG | ODD GRB | 730 |
| Control code 5 | EVEN GRB | ODD BRG | EVEN GRB | ODD BRG | 740 |
| Control code 0 | EVEN RGB | ODD BGR | EVEN RGB | ODD BGR | 750 |
| Control code 1 | EVEN BGR | ODD RGB | EVEN BGR | ODD RGB | 760 |

700C

Fig. 7C

LIQUID CRYSTAL ON SILICON (LCOS) DISPLAY DRIVING SYSTEM AND THE METHOD THEREOF

BACKGROUND

1. Field of Invention

The present invention relates to a LCOS (Liquid Crystal On Silicon) display field. More particularly, the present invention relates to a color LCOS display loading the R, G, and B data in a non-sequential pattern.

2. Description of Related Art

In a conventional color LCOS display driving system, a driving set of a level shifter, a Digital Analog Converter (DAC), and a unity-gain buffer is required for each R, G, and B data supplied to a pixel. Therefore, for example, if there are 80 pixels in a scan line, driving sets with total number of 240 may be required. This architecture significantly increases the manufacturing cost and complexity of the LCOS display driving system.

Recently, a color LCOS display driving system with shared components, such as a shared level shifter, a shared DAC, and a shared unity-gain buffer for all R, G, and B data supplied to a pixel is proposed. This type of LCOS display driving system employs a multiplexer and a demultiplexer for managing the R, G, and B data to the shared level shifter, the shared DAC, and shared buffer, so that separate driving sets for each R, G, and B data are no longer required. The color LCOS display driving system utilizing this approach is disclosed in U.S. Pat. No. 6,097,632, which is incorporated herein by reference.

FIG. 1 is a block diagram illustrating a color LCOS display driving system 100 with a shared driving set. The shift register 110 shifts a load signal from a data bus (not shown). A first R data latch 120A, first G data latch 120B, and first B data latch 120C latch the R, G, and B data from the data bus respectively while receiving the load signal from the shift register 110. A second R data latch 130A, second G data latch 130B, and second B data latch 130C further latch the R, G, and B data from the first R data latch 120A, first G data latch 120B, and first B data latch 120C, correspondingly.

The multiplexer 140 then multiplexes the R, G, and B data that one of them enters a shared level shifter 150 each time for shifting the level. The level shifted R, G, or B data are then transferred to a shared DAC 160 for converting the R, G, or B data to a corresponding analog R, G, or B data voltage. The shared unity-gain buffer 170 then follows the analog R, G, or B data voltages. Thereafter, the demultiplexer 180 demultiplexes the analog R, G, or B data voltage from the shared unity-gain buffer 170 and outputs to a corresponding pixel.

In the conventional LCOS display driving system 100, the multiplexer 140/demultiplexer 180 multiplexes/demultiplexes the R, G, and B data in a sequential pattern. That is, the loading sequences for all pixels in all scan lines are all identical. For example, R data is loaded to the shared level shifter 150 first, followed by the G data, and finally the B data. FIG. 2 shows a frame 200 comprising multiple scan lines 210. Each scan line 210 is comprised of even pixels 210A and odd pixels 210B both having the identical loading sequence, RGB. All even pixels 210A and odd pixels 210B in all scan lines of frame 200 have the same loading sequence RGB.

However, while the R, G, and B data are loaded in this sequential pattern, a so-called "data line floating" effect will arise, and dramatically interfere with the adjacent data, resulting in an erroneous display. FIG. 3 is a timing chart illustrating the "data line floating" effect while the R, G, and B data are loaded in a sequential pattern. As shown in the FIG. 3, while the scan line is turned on for sequential loading the R, G, and B data, the switch 1 of the multiplexer 140 is first turned on for loading the R data. Subsequently, the switch 2 of the multiplexer 140 is turned on for loading the G data. Finally, the switch 3 of the multiplexer 140 is turned on for loading the B data. The loading of G and B data both couples to the previously loaded R data, resulting in an incorrect R data level. Similarly, the level of the G data is be coupled by the following B data. These coupling effects between the R, G, and B data in a scan line will lead to an erroneous display of the R, G, and B data.

Besides, during the demultiplexing, a clock feed-through effect will also cause a faulty display. FIG. 4 shows a circuit diagram in the demultiplexer 180. The demultiplexer 180 has PMOS transistor 181 and capacitors Cov 182. While a clock signal 183 is supplied, the analog R, G, or B data voltage is entered the input 184, and output from the output 185. However, due to the clock feedthrough, the output analog R, G, or B data voltage will increase an undesired clock feedthrough voltage, ΔV, determined by the formula:

$$\Delta V = \frac{V_{ck} \times WC_{ov}}{WC_{ov} + CH}$$

Where Vck is the clock signal voltage, Wcov is the capacitance of the capacitor Cov 182, and CH is the capacitance of the capacitor 186. The undesired clock feedthrough voltage ΔV can be as high as 50 mV. This clock feedthrough effect also results in an incorrect display and should be avoided.

For the forgoing reasons, there is a need for an improved LCOS display driving system and method that the coupling effect of between loaded data can be minimized. Besides, there is also a need for an improved LCOS display driving system and method that the clock feed-through effect can be avoided.

SUMMARY

It is therefore an objective of the present invention to provide a LCOS display driving system for minimizing the coupling effecting between the loaded data.

It is another objective of the present invention to provide a LCOS display driving system for minimizing the clock feedthrough effect.

It is still another objective of the present invention to provide a LCOS display driving method for minimizing the coupling effect and the feedthrough effect.

In accordance with the foregoing and other objectives of the present invention, a LCOS display driving system is provided. The LCOS display driving system comprises a driving sequential control block, a multiplexer, a shared level shifter, a shared digital analog converter, a shared unity-gain buffer, and a demultiplexer. The driving sequential control block generates a control code representing a loading sequence of the R data, the G data, and the B data for pixels in one of scan lines. The multiplexer multiplexes the R data, the G data and the B data from second latches according the control code from the driving sequential control block. The shared level shifter shifts the level of the R data, the G data, and the B data from the multiplexer. The shared digital analog converter converts the R data to an analog R data voltage, the G data to an analog G data voltage, and the B data to an analog B data voltage. The shared unity-gain buffer follows the analog R data voltage, the analog G data voltage, and the analog B data voltage from the shared digital analog converter. The demultiplexer demultiplexes the analog R data voltage, the analog G data voltage, and the analog B data voltage according the control code from the driving sequential control block.

In accordance with another objective of the present invention, a LCOS display driving method is provided. First, generate a control code representing a loading sequence of the R, G, and B data for pixels in one of scan lines. Then, multiplex the R, G, and B data according the control code. Further, shift the levels of the R, G, and B data. Thereafter, convert the R, G, and B data to a corresponding analog R, G, and B data voltage. Furthermore, follow the analog R, G, and B data voltage. Finally, demultiplex the analog R, G, and B data voltage according the control code.

As embodied and broadly described herein, the present invention provides a LCOS display driving system and method that can minimize the coupling effect between the loaded data and the clock feedthrough effect. The data can therefore be more correctly and efficiently displayed.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

FIG. 7A to FIG. 7C are diagrams illustrating the loading sequence of the R, G, and B data in different frames according to a preferred embodiment of the present invention;

DESCRIPTION OF THE PREFERRED EMBODIMENTS

Figure 1:
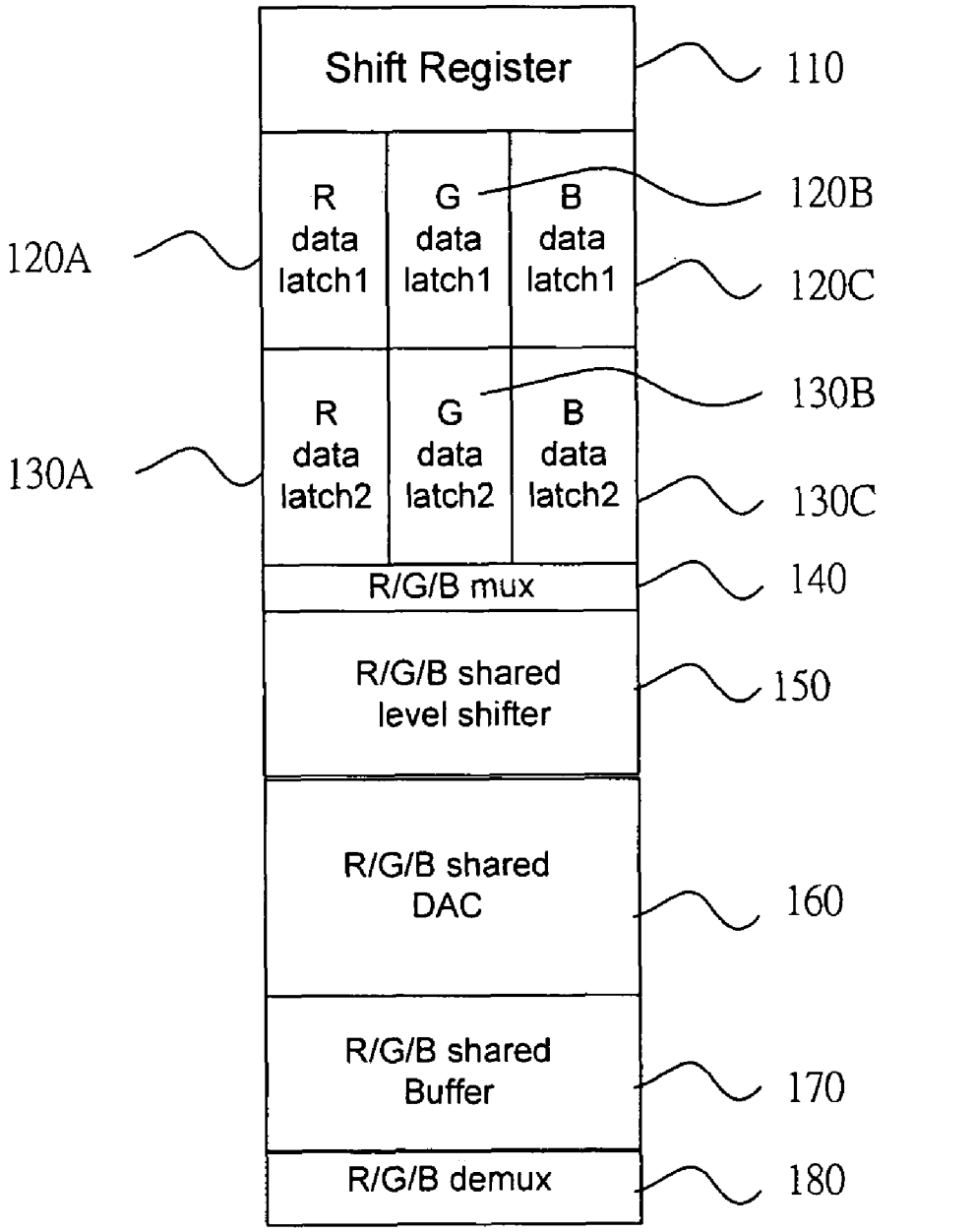
Fig. 1 (Prior Art)
FIG. 1 is a block diagram illustrating a LCOS display driving system in the prior art.
Figure 2:
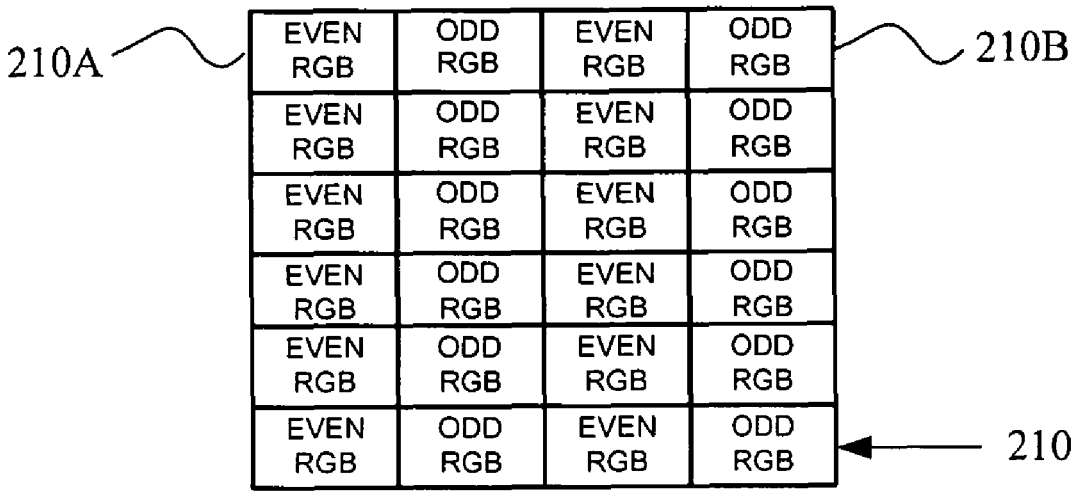
Fig. 2 (Prior Art)
FIG. 2 is a diagram illustrating the loading sequence of the R, G, and B data in a frame in the prior art.
Figure 3:
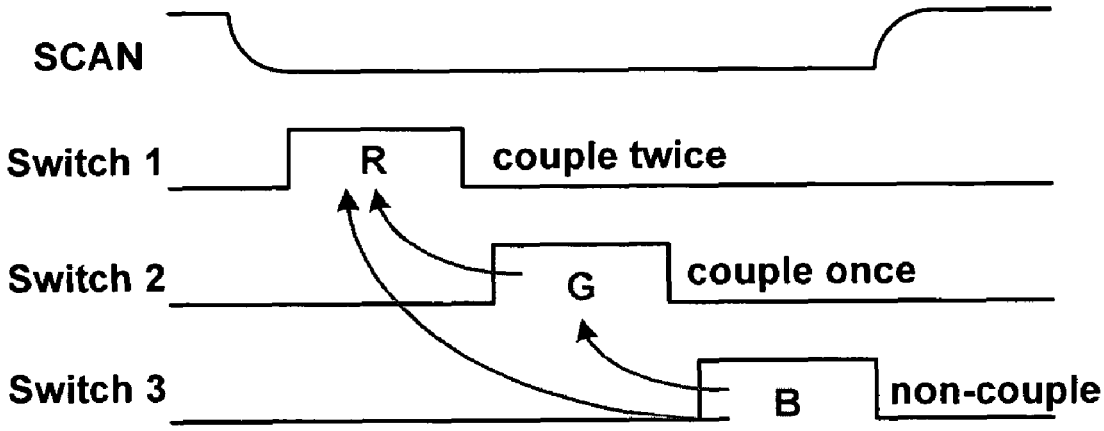
Fig. 3 (Prior Art)
FIG. 3 is a timing chart illustrating the coupling effect between the R, G, and B data in the prior art.
Figure 4:
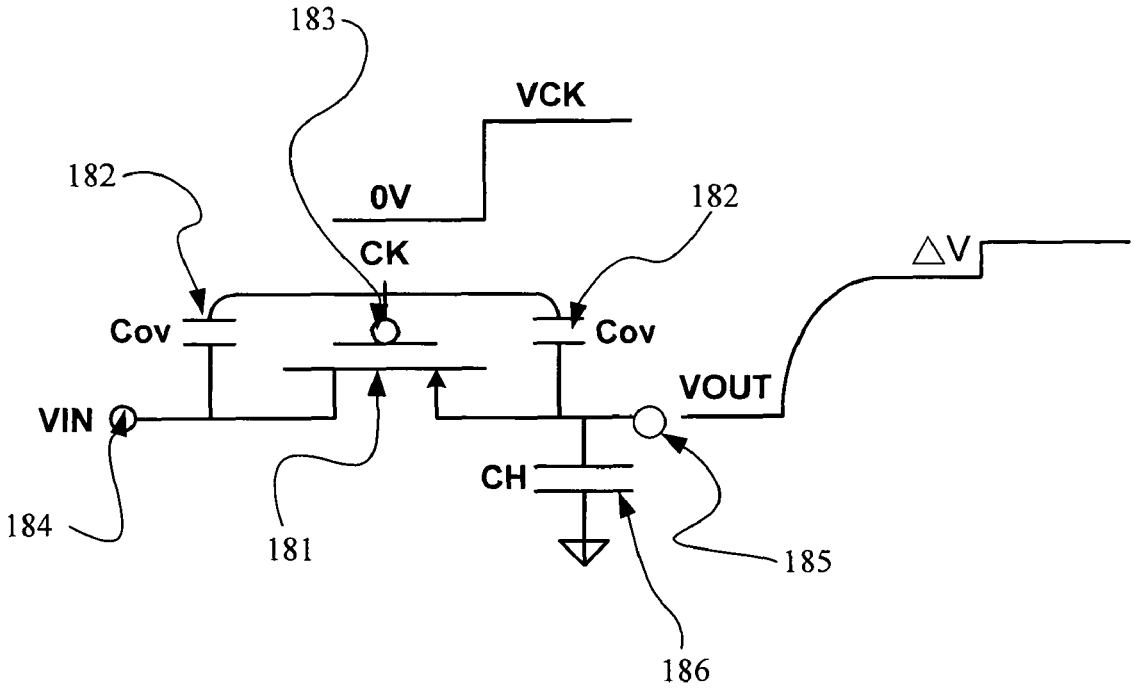
Fig. 4 (Prior Art)
FIG. 4 is a circuit diagram illustrating the clock feedthrough effect in the prior art.

Reference will now be made in detail to the present preferred embodiments of the invention, examples of which are illustrated in the accompanying drawings. Wherever possible, the same reference numbers are used in the drawings and the description to refer to the same or like parts.

The LCOS display driving system according to the present invention employs a non-sequential pattern for loading the R, G, and B data to pixels in each scan line that the coupling effecting between loaded data can be minimized. Besides, the LCOS display driving system according to the present invention further utilizes a data compensation block for compensating the clock feedthrough effect during the demulplexing.

Figure 5:
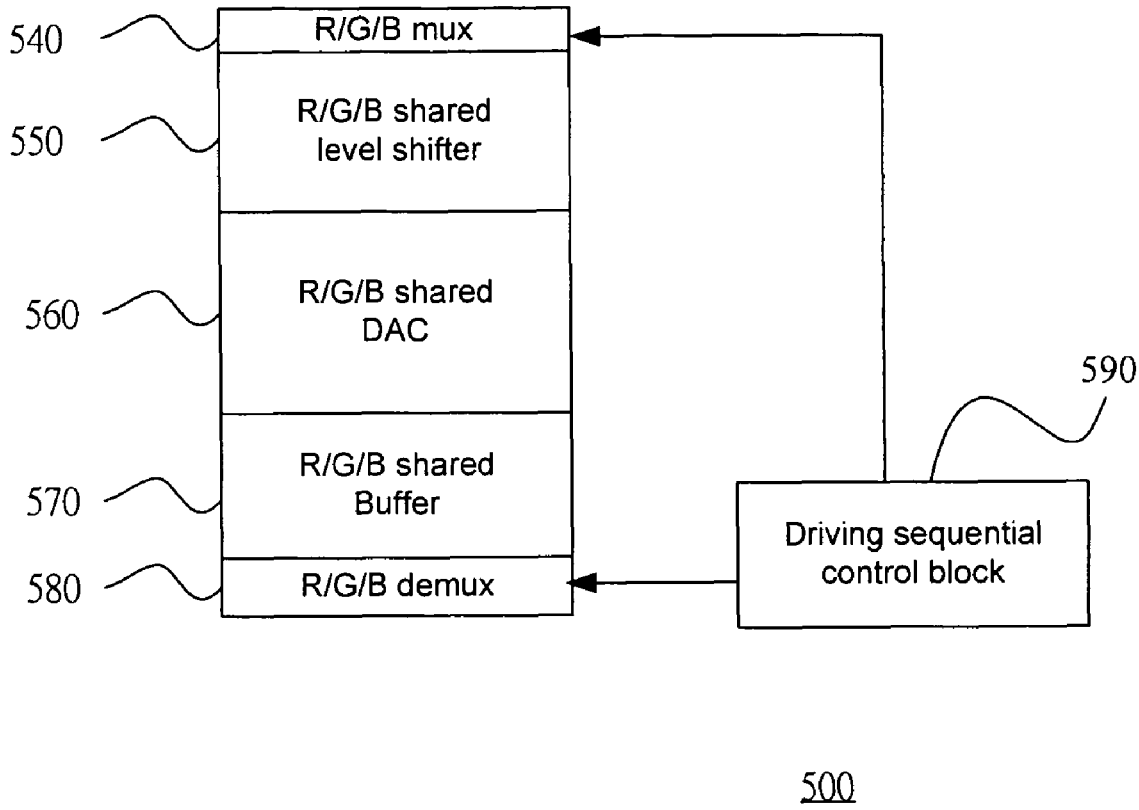
FIG. 5 is a block diagram illustrating a LCOS display driving system according to the present invention.

FIG. 5 is a block diagram illustrating the LCOS display driving system according to the present invention. The LCOS display driving system 500 comprises a multiplexer 540, a shared level shifter 550, a shared DAC 560, a shared unity-gain buffer 570, a demultiplexer 580, and a driving sequential control block 590.

The driving sequential control block 590 generates a control code representing a loading sequence of the R, G, and B data for pixels in one of scan lines. The multiplexer 540 multiplexes the R, G, and B data from a latch (not shown) according to the control code from the driving sequential control block 590. The shared level shifter 550 shifts the level of the R, G, and B data from the multiplexer 540. The shared DAC 560 converts the R, G, and B data to a corresponding analog R G, and B data voltage. The shared unity-gain buffer 570 follows the analog R, G, and B data voltage from the shared DAC 560. The demultiplexer 580 demultiplexes the analog R, G, and B data voltage to the pixels according to the control code from the driving sequential control block 590.

Figure 6:
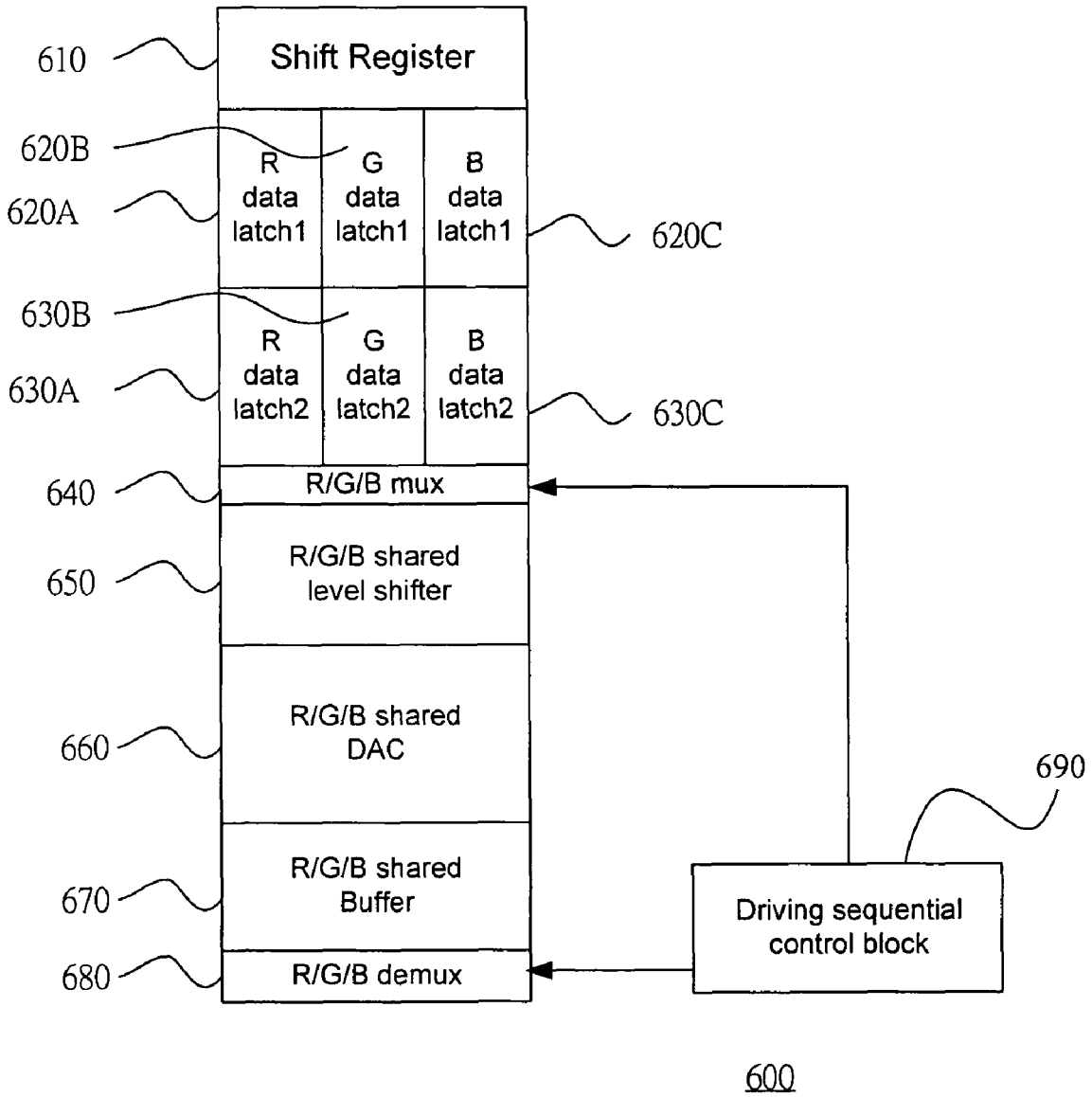
FIG. 6 is a block diagram illustrating a LCOS display driving system according to a preferred embodiment of the present invention.

FIG. 6 is a block diagram illustrating a LCOS display driving system 600 according to one preferred embodiment of the present invention. The shift register 610 shifts a load signal from a data bus (not shown). A first R data latch 620A, first G data latch 620B, and first B data latch 620C latch the R, G, and B data from the data bus respectively while receiving the load signal from the shift register 610. A second R data latch 630A, second G data latch 630B, and second G data latch 630C further latch the R, G, and B data from the first R data latch 620A, first G data latch 620B, and first B data latch 620C respectively. The driving sequential control block 690 generates a control code representing a loading sequence of the R, G, and B data for pixels in one of scan lines. The multiplexer 640 then multiplexes the R, G, and B data according to the control code. The shared level shifter 650 shifts the level of the R, G, and B data from the multiplexer 640. The R, G, and B data are further transferred to the shared DAC 660 for converting the R, G, and B data to a corresponding analog R, G, and B data voltage. Subsequently, the shared unity-gain buffer 670 follows the analog R, G, and B data voltage for providing a superior driving ability. The demultiplexer 680 demultiplexes the analog R, G, and B data voltage according to the control code from the driving sequential control block 690, and outputs to the pixels in the scan lines.

Figure 7A:
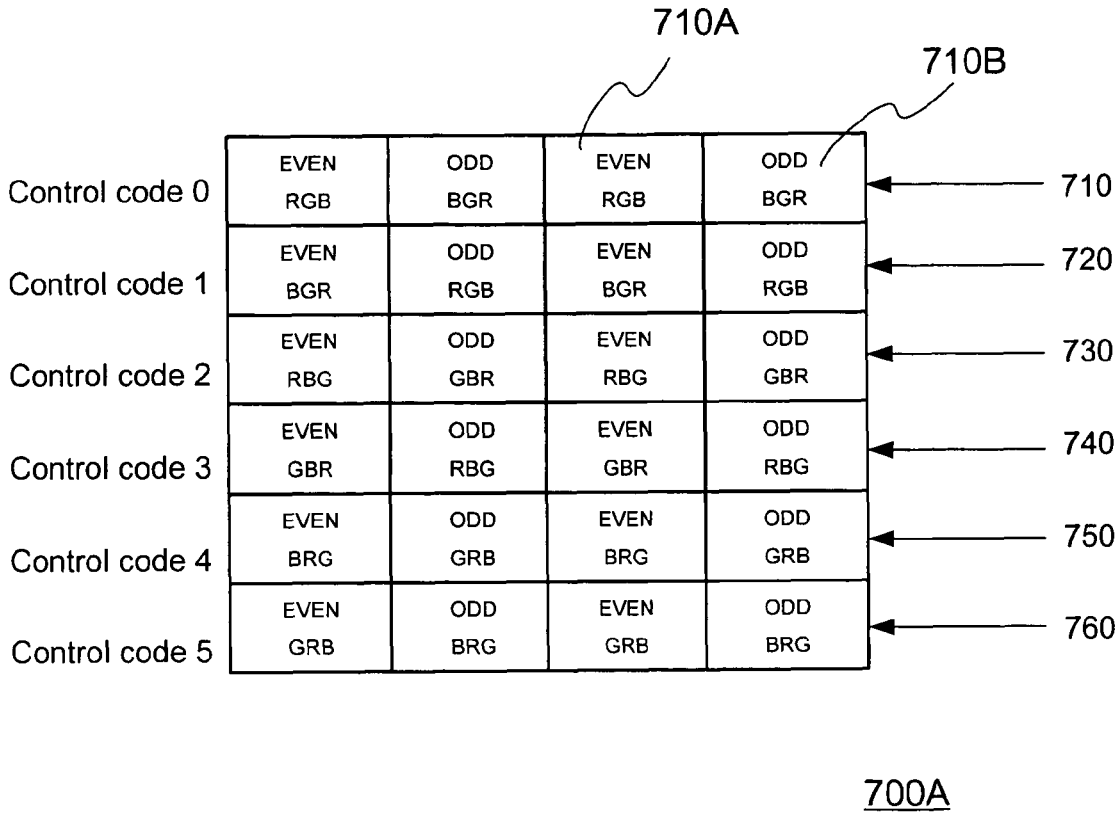

FIG. 7A to FIG. 7C are diagrams illustrating how the multiplexer 640/demultiplexer 680 multiplexes/demultiplexes the R, G, and B data according to the control code generated by the driving sequential control block 690. FIG. 7A shows a first frame 700A comprising six scan lines 710~760. Each scan line is comprised of even pixels and odd pixels. For example, in the first scan line 710, there are even pixel 710A and odd pixel 710B. In the first frame 7A, the driving sequential control block 690 generates a control code 0 for the first scan line 710. The control code 0 represents a loading sequence of RGB for the even pixel 710A, and the loading sequence for the odd pixel 710B is BGR, which is the reverse loading sequence of the even pixel 710A. Further, the driving sequential control block 690 generates a control code 1 for the second line 720. The control code 1 represents a loading sequence of BGR for the even pixel 720A and a loading sequence of RGB for the odd pixel 720B, which is the reverse loading sequence of the even pixel 720A. As can be noted from the FIG. 7A, in fact, the loading sequence of the even pixel 710A in the first scan line 710 is identical to the one of the odd pixel 720B in the second scan line 720, while the loading sequence of the odd pixel 710B in the first scan line 710 is identical to the one of the even pixel 720A in the second scan line 720.

Likewise, the driving sequential control block 690 generates a control code 2 for the third scan line 730, representing a loading sequence of RBG for the even pixel 730A and a loading sequence of GBR for the odd pixel 730B. Further, the driving sequential control block 690 generates a control code 3 for the fourth scan line 740, representing a loading sequence of GBR for the even pixel 740A and a loading sequence of RBG for the odd pixel 740B.

Besides, the driving sequential control block 690 generates a control code 4 for the fifth scan line 750, representing a loading sequence of BRG for the even pixel 750A and a loading sequence of GRB for the odd pixel 750B. Further, the driving sequential control block 690 generates a control code 5 for the sixth scan line 760, representing a loading sequence of GRB for the even pixel 760A and a loading sequence of BRG for the odd pixel 760B.

In this strategy, the R, G, and B data can be loaded to pixels of scan lines in a non-sequential pattern. As can be seen from the FIG. 7A, in the first frame, the control code sequence from the first to sixth scan lines is 012345.

In the second frame, the control code for each scan line will differ from the one in the first frame. FIG. 7B shows that in the second frame 700B, the driving sequential control block 690 generates a control code 4 instead of control code 0 for the first scan line 710, while a control code 5 is generated for the second scan line 720 instead of control code 1. Therefore, in the second frame 700B, the loading sequence of the even pixel 710A and odd pixel 710B in the first scan line 710 will be BRG and GRB respectively. In the second frame, the control code sequence from the first to sixth scan line now is 450123. In other words, the control codes 0 and 1 of the first and second scan lines in the first frame are now shifted downward to the third and fourth scan lines in the second frame, while the control codes 2 and 3 of the third and fourth scan lines in the first frame are shifted downward to the fifth and sixth scan lines in the second frame. And the control code 4 and 5 of the fifth and sixth scan lines in the first frame are shifted upward to the first and second scan lines in the second frame.

FIG. 7C shows that in the third frame 700C, the control code sequence from the first to sixth scan line is now 234501. In other words, the control code 0 and 1 of the third and fourth scan lines in the second frame are now further shifted downward to the fifth and six scan lines in the third frame.

Therefore, the loading sequence for pixels in each scan line will vary according to the control code generated from the driving sequential control block in different frames. This brings significant advantages for randomizing the loading sequences of pixels in each scan line during different frames, and the coupling effect between loaded data can be minimized.

Figure 8:
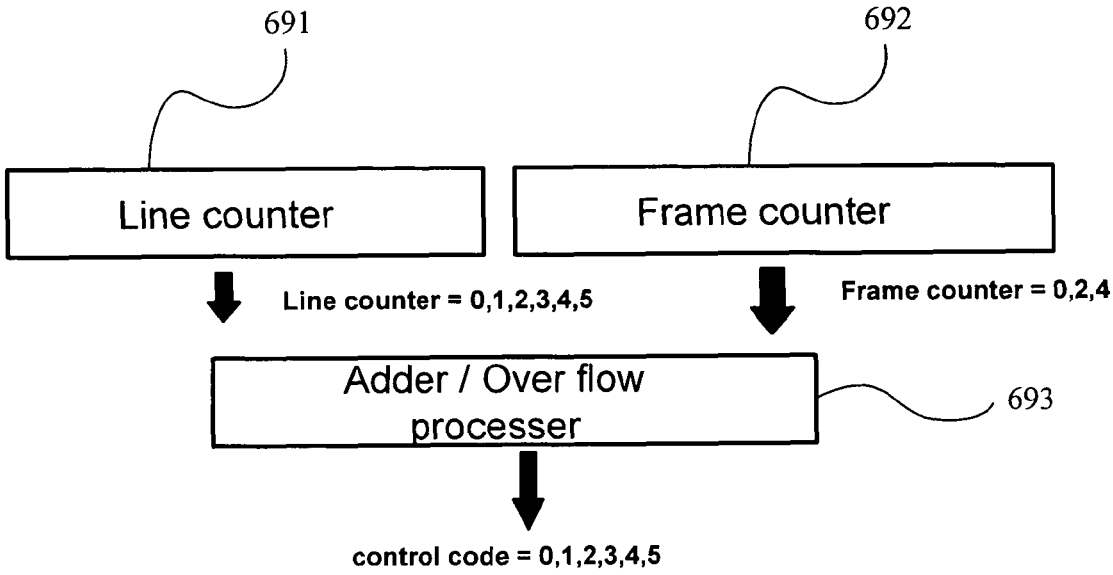
FIG. 8 is a block diagram illustrating the driving sequential control block according to a preferred embodiment of the present invention.

FIG. 8 is an internal block diagram of the driving sequential control block 690, demonstrating how the driving sequential control block 690 generates the control code for each scan line in different frames. The driving sequential control block 690 comprises a line counter 691, a frame counter 692, and an adder/over flow processor 693. The adder/over flow processor 693 generates the control codes 0~5 based on the line counter 691 and the frame counter 692. The line counter 691 is used to count every six scan lines, while the frame counter 692 is used to count every three frames. The value of the line counter 691 is from 0 to 5, representing the first to sixth scan line. The value of the frame counter 692 is 0, 2, 4, representing the first, second, and third frame correspondingly.

Figure 9:
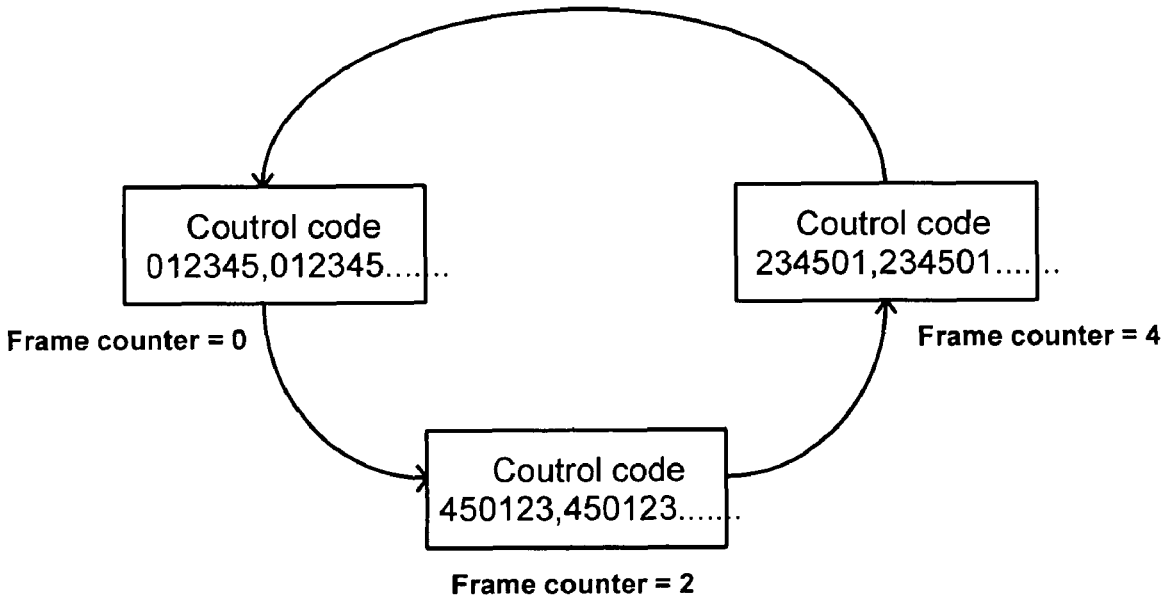
FIG. 9 is a diagram summarizing the control code sequence in different frames according a preferred embodiment of the present invention.

FIG. 9 is a block diagram summarizing the control code sequence in each frame. While the frame counter is 0, representing the first frame, the control code sequence for the first to the sixth scan line is 012345. While the frame counter is 2, representing the second frame, the control code sequence for the first to sixth scan line is 450123. And when the frame counter is 4, representing the third frame, the control code sequence for the first to sixth scan lines is 234501.

Figure 10:
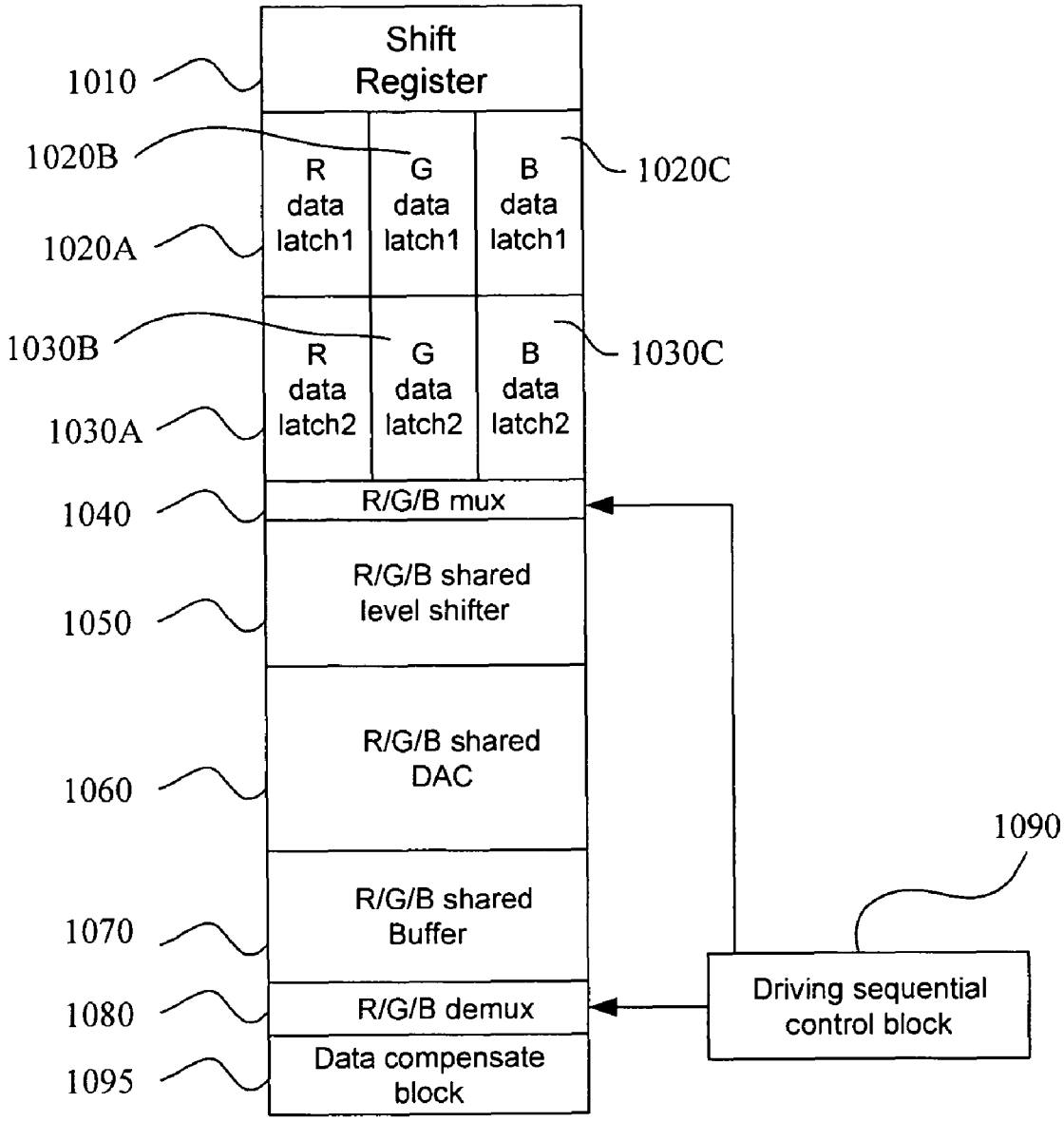
FIG. 10 is a block diagram illustrating a LCOS display driving system according to another preferred embodiment of the present invention.

Besides, a data compensation block can be implemented to compensate the clock feedthrough effect in the demultiplexer. FIG. 10 is a block diagram illustrating a LCOS display driving system 1000 according to another preferred embodiment of the present invention. The shift register 1010 shifts the R, G, and B data from a data bus (not shown). A first R data latch 1020A, first G data latch 1020B, and first B data latch 1020C latch the R, G, and B data from the data bus respectively while receiving the load signal from the shift register 1010. A second R data latch 1030A, second G data latch 1030B, and second B data latch 1030C further latch the R, G, and B data from the first R data latch 1020A, first G data latch 1020B, and first B data latch 1020C correspondingly. The driving sequential control block 1090 generates a control code representing a loading sequence of the R, G, and B data for pixels in one of scan lines. Afterward, the multiplexer 1040 multiplexes the R, G, and B data to the shared level shifter 1050 according to the control code. The shared level shifter 1050 shifts the level of the R, G, and B data from the multiplexer 1040. The R, G, and B data are then transferred to the shared DAC 1060 for converting the R, G, and B data to a corresponding analog R, G, and B data voltage. The shared unity-gain buffer 1070 follows the analog R, G, and B data voltage for providing a superior driving ability, and the demultiplexer 1080 demultiplexes the R, G, and B data according to the control code generated from the driving sequential control block 1090. The demultiplexed R, G, and B data are then transferred to the data compensation block 1095 for compensating the clock feedthrough voltage caused by the clock feedthrough effect.

Figure 11:
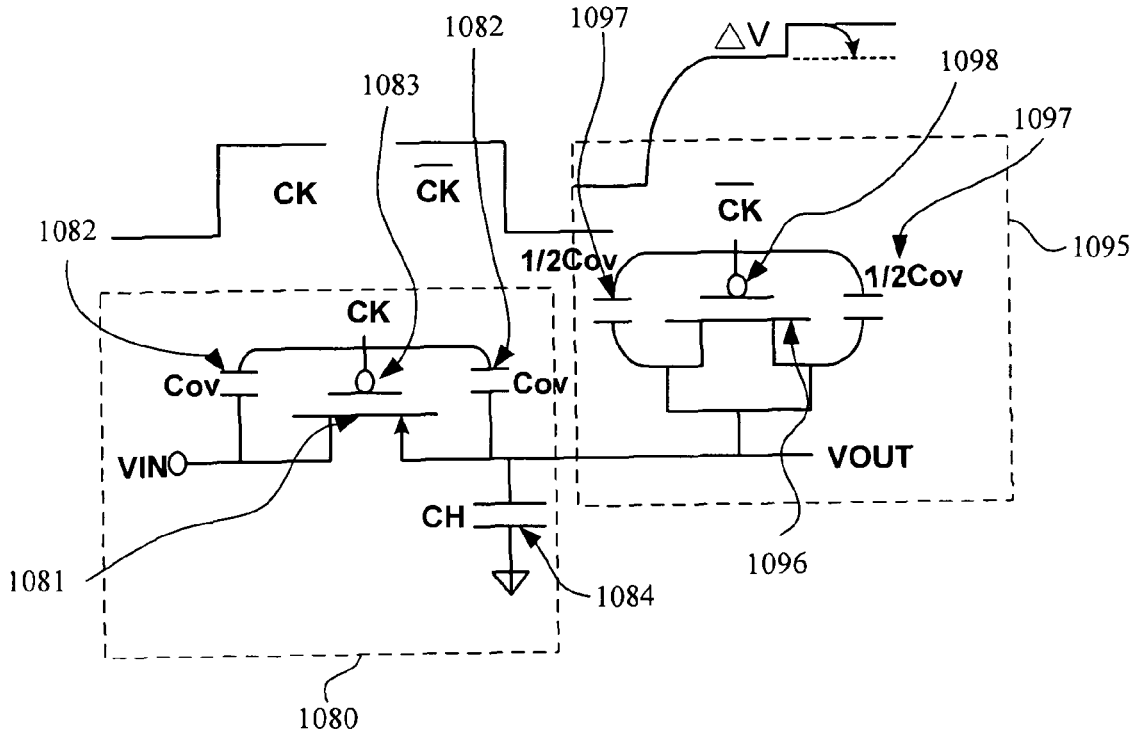
FIG. 11 is a circuit diagram illustrating the data compensation block according to another preferred embodiment of the present invention.

FIG. 11 shows a circuit diagram of the data compensation block 1095. The data compensation block 1095 comprises a PMOS transistor 1096 and capacitors ½ Cov 1097. The data compensation block 1095 is connected to the demultiplexer 1080. The demultiplexer 1080 comprises a PMOS transistor 1081 and capacitors Cov 1082. The width of the PMOS transistor 1096 is half of the PMOS transistor 1081, while the gate length of the PMOS transistor 1096 is equal to the PMOS transistor 1081. By supplying a counter clock signal 1098 to the PMOS transistor 1096, which is reverse to the clock signal 1083 in the demultiplexer 1080, the clock feedthrough voltage ΔV in the demultiplexer 1080 can be compensated according to the following formula:

$$\Delta V = \frac{V_{ck} \times WC_{ov} - V_{ck} \times \left(\frac{1}{2} WC_{ov}\right) \times 2}{WC_{ov} + CH} \approx 0$$

Where Vck is the clock signal voltage, Wcov is the capacitance of the capacitor Cov 1082, and CH is the capacitance of the capacitor 1084.

Figure 12:
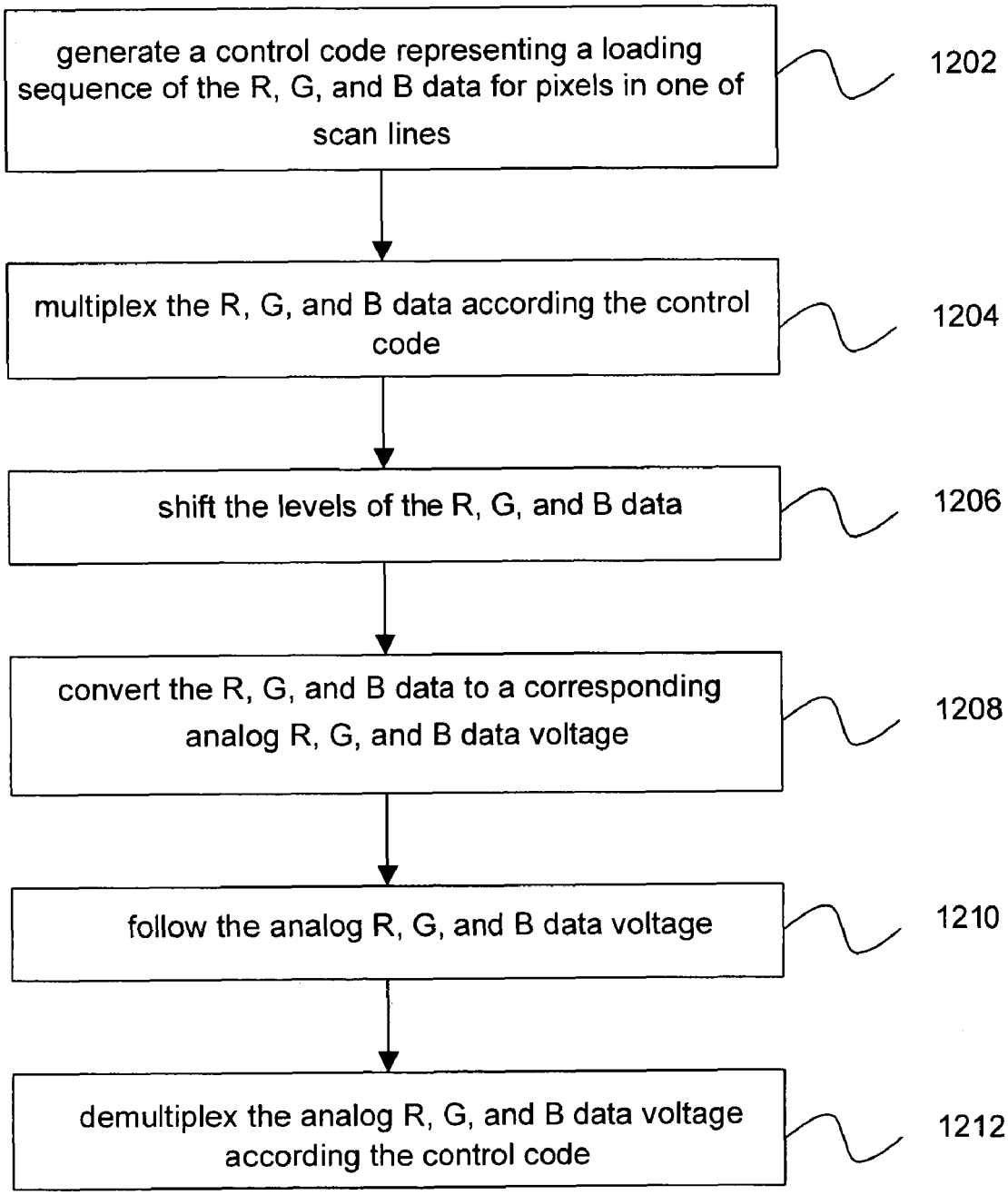
FIG. 12 is a flow chart illustrating a LCOS display driving method according to the present invention.

FIG. 12 is a flowchart illustrating the LCOS display driving method according to the present invention. First, generate a control code representing a loading sequence of the R, G, and B data for pixels in one of scan lines (step 1202). Then, multiplex the R, G, and B data according the control code (step 1204). Further, shift the levels of the R, G, and B data (step 1206). Thereafter, convert the R, G, and B data to a corresponding analog R, G, and B data voltage (step 1208). Furthermore, follow the analog R, G, and B data voltage (step 1210). Finally, demultiplex the analog R, G, and B data voltage according the control code (step 1212).

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A liquid crystal on silicon display driving system, the liquid crystal on silicon display driving system comprising:

a driving sequential control block for generating a plurality of control codes for corresponding scan lines within a frame, each of the control codes representing different loading sequences of R data, G data, and B data corresponding to even pixels and odd pixels in one of the scan lines, the loading sequences represented by the control codes for the corresponding scan lines being different from one another within the frame;

a multiplexer for multiplexing the R data, the G data and the B data from latches according the control code generated by the driving sequential control block;

a shared level shifter for shifting levels of the R data, the G data, and the B data from the multiplexer;

a shared digital analog converter for converting the R data to an analog R data voltage, the G data to an analog G data voltage, and the B data to an analog B data voltage;

a shared unity-gain buffer for following the analog R data voltage, the analog G data voltage, and the analog B data voltage from the shared digital analog converter; and a demultiplexer for demultiplexing the analog R data voltage, the analog G data voltage, and the analog B data voltage according the control code generated by the driving sequential control block.

2. The liquid crystal on silicon display driving system of claim 1, wherein when the control code is 0, the loading sequence is RGB for the even pixels of the scan line and BGR for the odd pixels of the scan line, when the control code is 1, the loading sequence is BGR for the even pixels of the scan line and RGB for the odd pixels of the scan line, when the control code is 2, the loading sequence is RBG for the even pixels of the scan line and GBR for the odd pixels of the scan line, when the control code is 3, the loading sequence is GBR for the even pixels of the scan line and RBG for the odd pixels of the scan line, when the control code is 4, the loading sequence is BRG for the even pixels of the scan line and GRB for the odd pixels of the scan line, when the control code is 5, the loading sequence is GRB for the even pixels of the scan line and BRG for the odd pixels of the scan line.

3. The liquid crystal on silicon display driving system of claim 2, wherein in the first frame of the frames, the control codes for the first to the sixth scan lines of the scan lines are 012345.

4. The liquid crystal on silicon display driving system of claim 2, wherein in the second frame of the frames, the control codes for the first to the sixth scan lines of the scan lines are 450123.

5. The liquid crystal on silicon display driving system of claim 2, wherein in the third frame of the frames, the control codes for the first to the sixth scan lines of the scan lines are 234501.

6. The liquid crystal on silicon display driving system of claim 1, wherein the driving sequential control block comprises a line counter for counting the scan lines, a frame counter for counting the frames, and an adder/over flow processor for generating the control code according to the line counter and the frame counter.

7. The liquid crystal on silicon display driving system of claim 1, wherein the line counter counts every six of the scan lines, and the frame counter counts every three of the frames.

8. The liquid crystal on silicon display driving system of claim 1, further comprising a data compensation block for compensating a clock feedthrough voltage of the analog R data voltage, the analog G data voltage, and the analog B data voltage from the demultiplexer.

9. The liquid crystal on silicon display driving system of claim 8, wherein the data compensation block comprises a PMOS transistor for compensating the clock feedthrough voltage.

10. The liquid crystal on silicon display driving system of claim 9, wherein the width of the PMOS transistor of the data compensation block is half of a width of a PMOS transistor of the demultiplexer, and the gate length of the PMOS transistor of the data compensation block is equal to a gate length of the PMOS transistor of the demultiplexer.

11. A liquid crystal on silicon display driving method, the liquid crystal on silicon display driving method comprising:

generating a plurality of control codes for corresponding scan lines within a frame, each of the control codes representing different loading sequences of R data, G data, and B data corresponding to even pixels and odd pixels in one of the scan lines of frames, the loading sequences represented by the control codes for the corresponding scan lines being different from one another within the frame;

multiplexing the R data, the G data and the B data according the control code;

shifting levels of the R data, the G data, and the B data ;

converting the R data to an analog R data voltage, the G data to an analog G data voltage, and the B data to an analog B data voltage;

following the analog R data voltage, the analog G data voltage, and the analog B data voltage; and demultiplexing the analog R data voltage, the analog G data voltage, and the analog B data voltage according the control code.

12. The liquid crystal on silicon display driving method of claim 11, wherein when the control code is 0, the loading sequence is RGB for the even pixels of the scan line and BGR for the odd pixels of the scan line, when the control code is 1, the loading sequence is BGR for the even pixels of the scan line and RGB for the odd pixels of the scan line, when the control code is 2, the loading sequence is RBG for the even pixels of the scan line and GBR for the odd pixels of the scan line, when the control code is 3, the loading sequence is GBR for the even pixels of the scan line and RBG for the odd pixels of the scan line, when the control code is 4, the loading sequence is BRG for the even pixels of the scan line and GRB for the odd pixels of the scan line, when the control code is 5, the loading sequence is GRB for the even pixels of the scan line and BRG for the odd pixels of the scan line.

13. The liquid crystal on silicon display driving method of claim 12, wherein in the first frame of the frames, the control codes for the first to the sixth scan lines of the scan lines are 012345.

14. The liquid crystal on silicon display driving method of claim 12, wherein in the second frame of the frames, the control codes for the first to the sixth scan lines of the scan lines are 450123.

15. The liquid crystal on silicon display driving method of claim 12, wherein in the third frame of the frames, the control codes for the first to the sixth scan lines of the scan lines are 234501.

16. The liquid crystal on silicon display driving method of claim 11, wherein the step of generating the control code is performed by a driving sequential control block.

17. The liquid crystal on silicon display driving method of claim 16, wherein the driving sequential control block comprises a line counter for counting the scan lines, a frame counter for counting the frames, and an adder/over flow processor for generating the control code according to the line counter and the frame counter.

18. The liquid crystal on silicon display driving method of claim 17, wherein the line counter counts every six of the scan lines, and the frame counter counts every three of the frames.

19. The liquid crystal on silicon display driving method of claim 11, further comprising compensating a clock feedthrough voltage of the analog R data voltage, the analog G data voltage, and the analog B data voltage.

20. The liquid crystal on silicon display driving method of claim 19, wherein the step of compensating the clock feedthrough voltage is performed by a data compensation block, and the step of demultiplexing the analog R data voltage, the analog G data voltage, and the analog B data voltage is performed by a demultiplexer.

21. The liquid crystal on silicon display driving method of claim 20, wherein the data compensation block comprises a PMOS transistor for compensating the clock feedthrough voltage.

22. The liquid crystal on silicon display driving method of claim 21, wherein the width of the PMOS transistor of the data compensation block is half of a width of a PMOS transistor of the demultiplexer, and the gate length of the PMOS transistor of the data compensation block is equal to a gate length of the PMOS transistor of the demultiplexer.

* * * * *